US006253799B1

(12) United States Patent
Guzowski et al.

(10) Patent No.: US 6,253,799 B1
(45) Date of Patent: Jul. 3, 2001

(54) METHOD FOR CONTROLLING BULK SUPPLY OF MATERIAL TO INTEGRAL PNEUMATIC DISPENSER

(75) Inventors: Raymond J. Guzowski, Fenton; David W. Lazar, Troy; Jeffrey Slagle, Goodrich, all of MI (US)

(73) Assignee: Fanuc Robotics North America, Inc., Rochester Hills, MI (US)

( * ) Notice: Subject to any disclaimer, the term of this patent is extended or adjusted under 35 U.S.C. 154(b) by 0 days.

(21) Appl. No.: 09/607,826

(22) Filed: Jun. 30, 2000

(51) Int. Cl.[7] ..... B65B 1/04; B65B 3/04

(52) U.S. Cl. ..... 141/2; 141/18; 141/83; 141/94

(58) Field of Search ..... 141/2, 18, 83, 141/94, 95, 192, 196, 198; 222/1

(56) References Cited

U.S. PATENT DOCUMENTS 3,871,556 3/1975 Breer et al. ..... 222/132
4,458,827 7/1984 Stelte ..... 222/1
5,823,389 * 10/1998 Guzowski ..... 222/1
5,857,589 1/1999 Cline et al. ..... 222/1

* cited by examiner

*Primary Examiner*—Timothy L. Maust
(74) *Attorney, Agent, or Firm*—Bliss McGlynn, P.C.

(57) ABSTRACT

A method is disclosed for reloading a plurality of shotmeters supplying fluid material to a plurality of robots from a bulk supply. The method is capable of alternating which of the shotmeters is being reloaded at any given time. This greatly reduces the capacity requirements of the bulk supply. The method includes the steps of activating one of the shotmeters to define a primary shotmeter. The material in the primary shotmeter is then dispensed. Once the primary shotmeter is emptied, the other of the two shotmeters associated with the robot is activated and becomes the primary shotmeter. This shotmeter then dispenses the material. A request is forwarded to the system programming logic controller to reload the emptied shotmeter. Once approval is received, the emptied shotmeter is reloaded. The system programming logic controller only allows the emptied shotmeter to reload when the emptied shotmeter is the only one of the plurality of shotmeters relying on the bulk supply at that time.

8 Claims, 4 Drawing Sheets

METHOD FOR CONTROLLING BULK SUPPLY OF MATERIAL TO INTEGRAL PNEUMATIC DISPENSER

BACKGROUND OF THE INVENTION

1. Field of the Invention

The invention relates to a method for controlling the bulk supply of material to be dispensed through a robot system. More specifically, the invention relates to a method for controlling the reloading of material into the bulk supply system in a manner that reduces the amount of material stationed in the bulk supply system.

2. Description of the Related Art

The manufacture of goods can often require the application of viscous materials. These materials may be used to paint, seal, coat, adhere, weld and the like. The material must be applied in a uniform and automated fashion. In many instances, the material is directed by a robot that has been programmed to apply materials to the items being manufactured or treated.

In many instances, several applicators are used for a particular product coating system. All of the applicators require material to operate. A standard deployment is shown as prior art in FIG. 1. Each of the six robots 11 shown require material from the bulk system, generally shown at 13. The rate at which the three robots and shotmeter pairs require material mandates at least three drums of material be stored adjacent thereto as bulk supply. Each of these drums requires two pumps to supply material at the rate demanded by the robots. In the embodiment shown in FIG. 1, each drum can supply 4.6 gallons per minute and each robot station requires 6.6 gallons per minute. Therefore, two drums must be active all the time with one inactive drum waiting as a stand by to the others.

This arrangement is costly due to the redundancy of parts. The drum and pump combinations are substantial investments due to their required size and robustness. The viscosity of the material being pumped can be quite high requiring the pumps to be heavy, rugged and costly. It is also costly because so much floor space is taken up to accommodate the drums.

SUMMARY OF THE INVENTION

A method for reloading a plurality of shotmeters supplying fluid material to a plurality of robots from a bulk supply includes the step of activating one of the shotmeters to define a primary shotmeter. Once activated, the method dispenses the material from the primary shotmeter. The method then determines when the primary shotmeter becomes empty. The method activates the other of the shotmeters to continue dispensing the material. A request is then forwarded to reload the primary shotmeter that has been emptied. Once approval is received, the primary shotmeter is reloaded but only when the primary shotmeter is the only one of the plurality of shotmeters relying on the bulk supply at that time.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
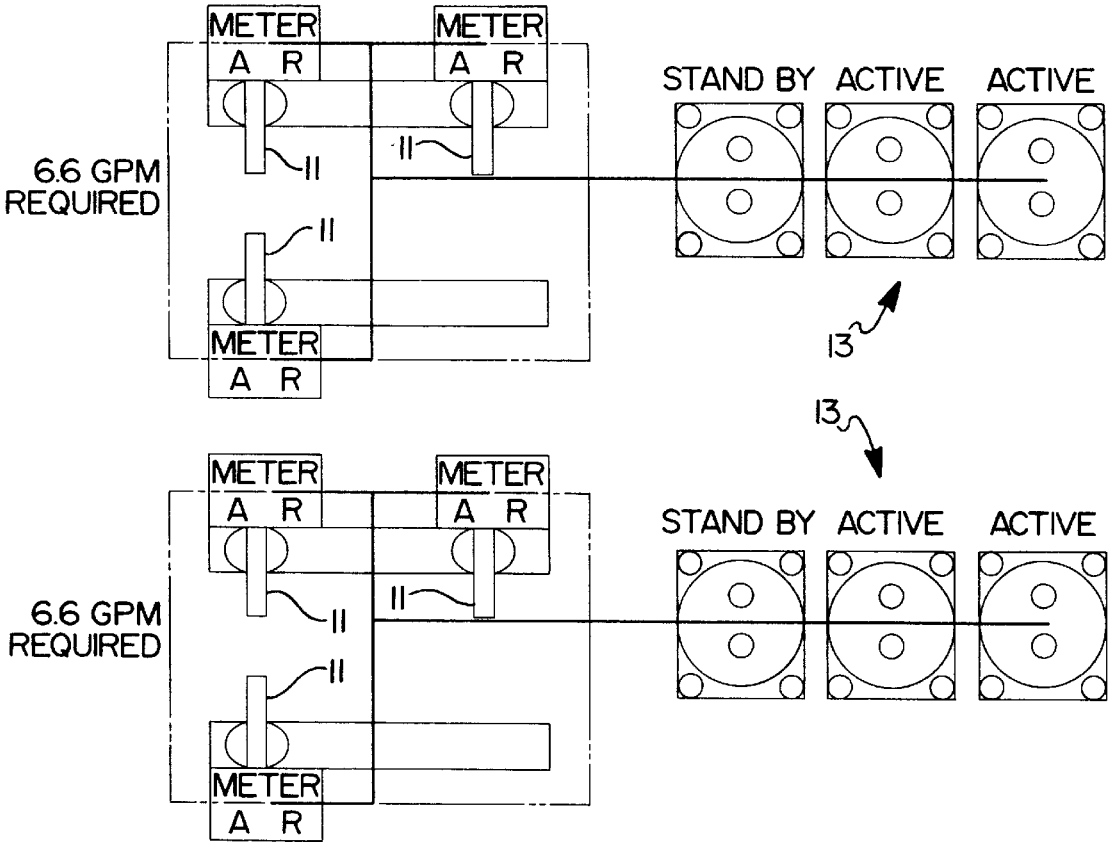
FIG 1 PRIOR ART
FIG. 1 is a schematic view of a prior art bulk supply configuration.
Figure 2:
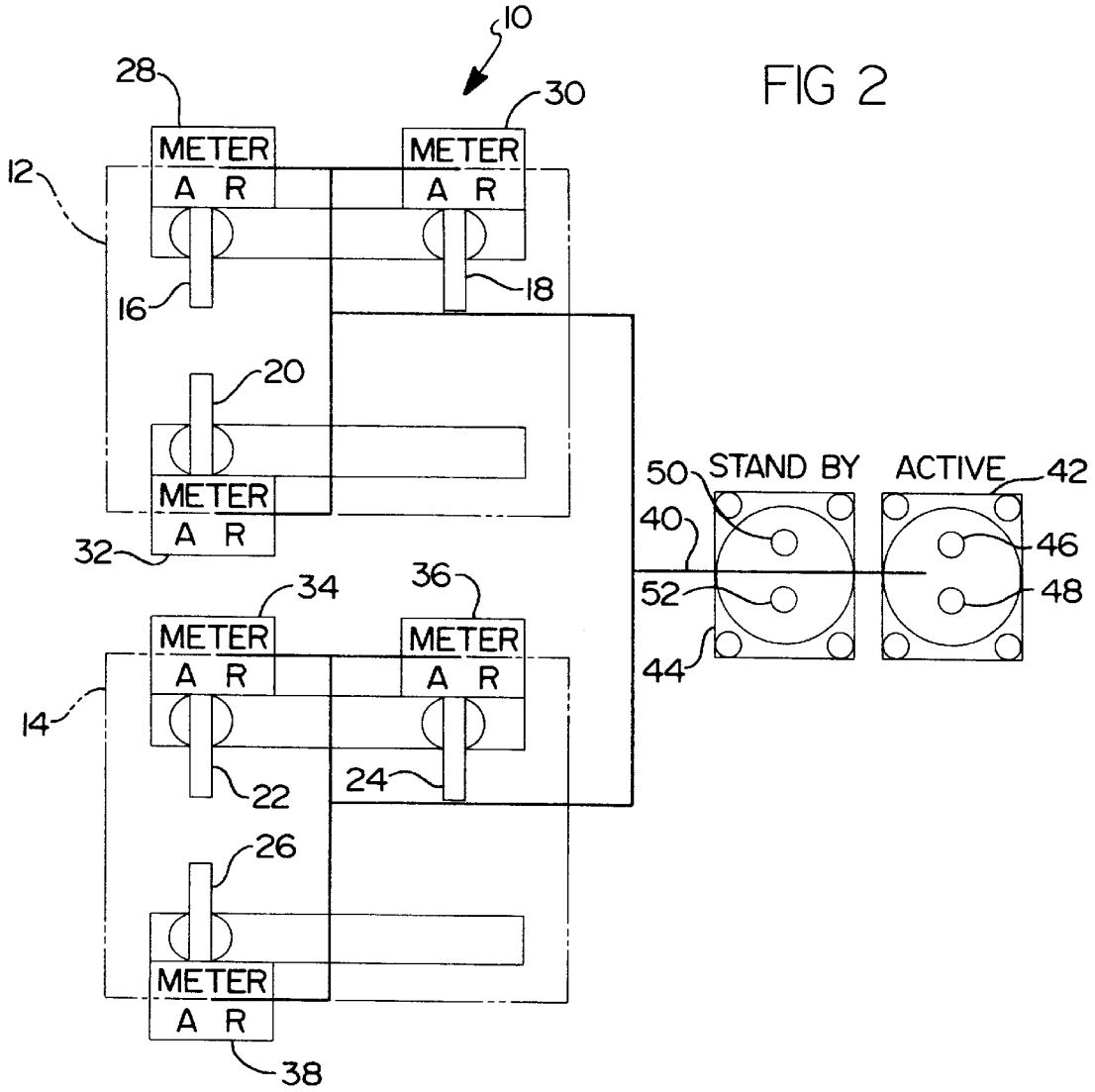
FIG. 2 is a schematic view of one embodiment of a bulk supply system incorporating the inventive method.

Referring to FIG. 2, one assembly incorporating the inventive method is generally indicated at 10. The assembly 10 includes two sets of robots 12, 14. The first set of robots 12 includes three robots 16, 18, 20. The second set of robots 14 includes robots 22, 24, 26. Each of the robots 16–26 includes a shotmeter 28, 30, 32, 34, 36, 38. The shotmeters 28–38 are configured to be dual shotmeters. Such a configuration of dual shotmeters is disclosed in a copending patent application of common assignment and cofiling herewith (attorney docket number 0602.00001). This patent application is hereby expressly incorporated by reference. Each of the shotmeters 28–38 have been labeled with one of the initials A and R to represent that each shotmeter 28–38 includes a shotmeter that is active and a second shotmeter that is being reloaded. These two states or conditions will be discussed in greater detail subsequently.

Each of the shotmeters 28–38 is fed material (not shown) through an inlet line 40. The inlet line 40 branches out to each of the shotmeters 28–38. The inlet line 40 receives its material from one of two drums 42, 44. The drums 42, 44, like the shotmeters 28–38, cooperate in that one drum 42 is in active mode and the other drum 44 is in standby mode. Both of the drums 42, 44 contain the material that is received by the shotmeters 28–38. When the active drum 42 is emptied, the standby drum 44 pumps the material to the shotmeters 28–38 through the inlet line 40.

Each of the drums 42, 44 include two pumps 46, 48, 50, 52. The pumps 46–52 pump the material from the drums 42, 44 through the inlet line 40 to the shotmeters 28–38. The pump pairs 46, 48 and 50, 52 are capable of pumping 4.6 gallons per minute of the material that is going to be dispensed through the robots 16–26. The pump pairs 46, 48 and 50, 52 are more than capable of supplying the requisite amount, 2.2 gallons per minute in the embodiment shown in FIG. 2, to supply the robots 16–26 with sufficient material to apply the material to the parts. The reason a single drum 42, 44 having two standard pumps 46, 48 and 50, 52 are capable of supplying the requisite amount of material to each of the robots 16–26 is that the inventive method reduces the required amount of material at any given time. It should be appreciated by those skilled in the art that the method may be modified depending on the capabilities and capacities of the pumps. If, as in the example above, the pump pairs 46, 48 and 50, 52 are capable of pumping 4.6 gallons per minute, it may be appreciated that the method may allow two shotmeters 28–38 to be reloaded at the same time because doubling the 2.2 gallons per minute requirement will still be within the capacity of the pump pairs 46, 48 and 50, 52.

Figure 3A:
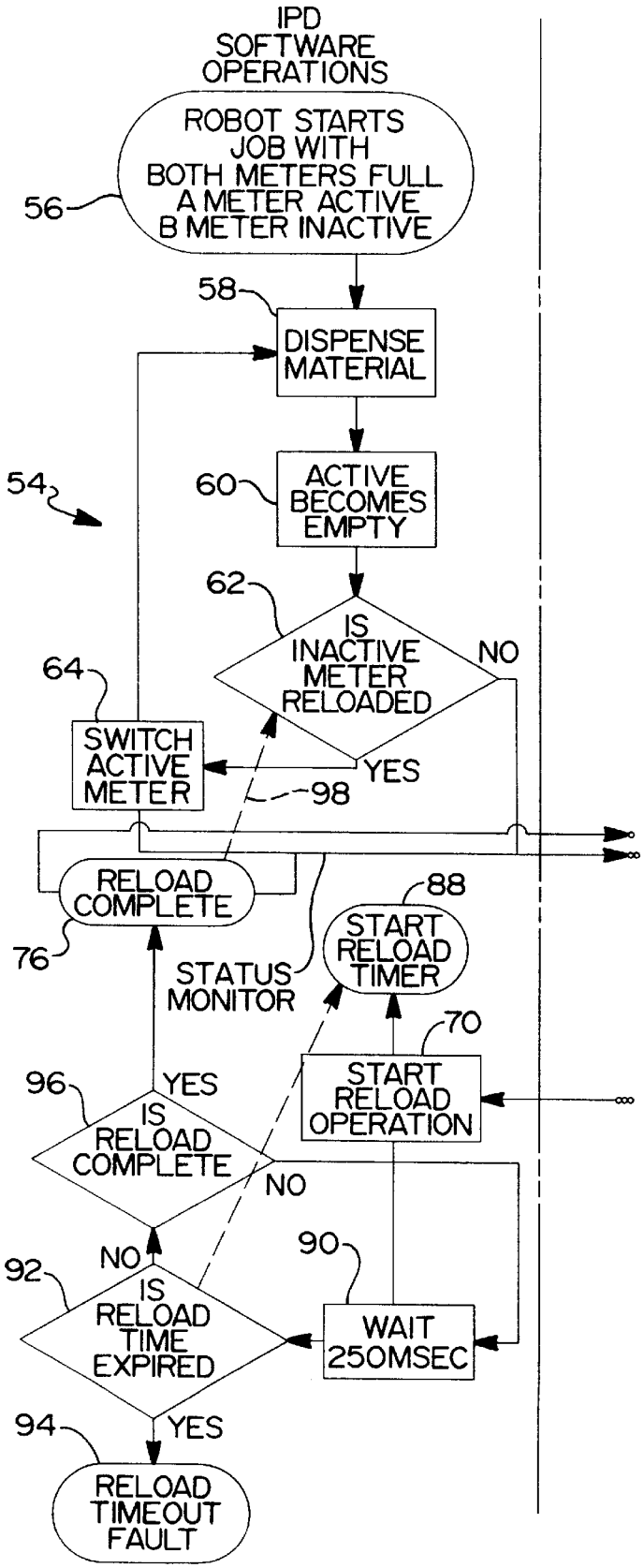
FIGS. 3A and 3B are a flowchart of one embodiment of the inventive method.
Figure 3B:
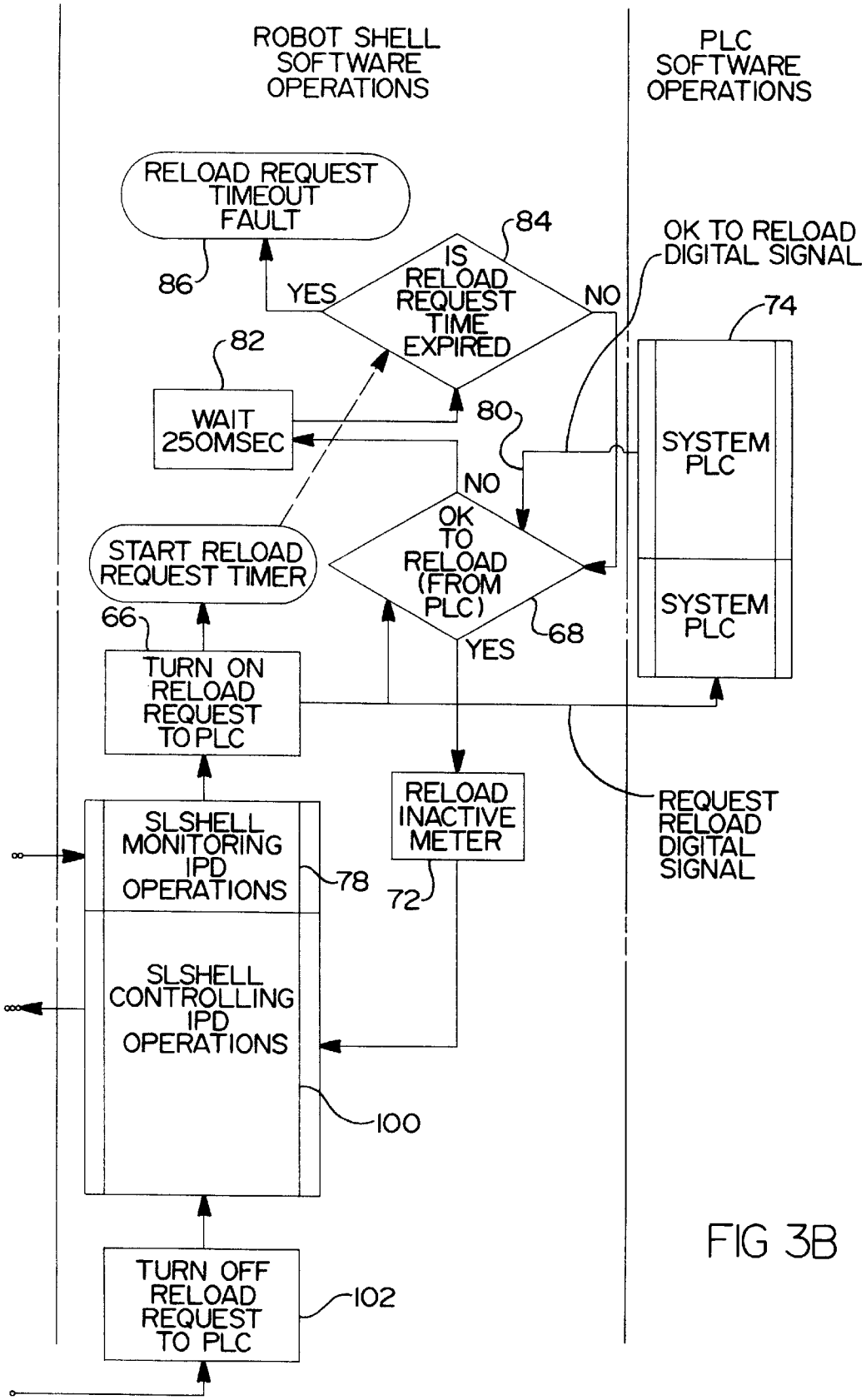

Referring to FIGS. 3A and 3B, a flowchart of the inventive method is generally indicated at 54. Reference to shotmeters 28–38 in FIGS. 3A and 3B have been changed to "meter" for purposes of brevity. Therefore, the remainder of this disclosure will refer to the shotmeters 28–38 as meters 28–38.

The method starts at 56 with both meters for each robot 16–26 full of material. One of the meters 28–38 is activated and defined as a primary meter. The material in the primary meter is then dispensed at 58. Once emptied at 60, the primary meter is tested to determine whether it has emptied at 62. This is done by determining whether the inactive meter has been reloaded. Initially, the inactive meter is reloaded because each robot 16–26 starts with both meters full. After the initial cycle, this test of the inactive meter becomes more important. If the inactive meter is full or reloaded, its status is switched from inactive to active at 64. By switching the status of the meters, the robots 16–26 are able to continue dispensing material without having to stop production to reload a single meter.

The newly inactivated meter, previously the primary meter, has been substantially emptied. This meter must be reloaded so that the robots 16–26 may continue to operate. According to the method 54, a request must be forwarded to the robot controller (not shown) to reload the inactive meter. The step is performed at 66. If the request to reload is approved at 68, the inactive meter is reloaded at 70. The instruction to reload the inactive meter at 72 is only given by a system programming logic controller 74 when the inactive meter is the only one of the plurality of meters that is relying on the bulk supply of material at that time. More specifically, only one meter is reloaded at a time. This reduces the requirement for greater rates of transfer of the material from the drums 42, 44 to the meters 28–38. By so reducing the rate of transfer, the inventive method 54 reduces the requirement for the number of drums 42, 44 that may operate up to six robots 16–26. Thus, the inventive method reduces the costs of operating a plurality of robots 16–26 by conserving the amount of material required to reload a meter 28–38 by controlling which of the meters 28–38 are being reloaded at any given time. Therefore, inherent in the method 54 is the step of waiting until all of the other meters 28–38 have completely reloaded before the step of receiving approval to reload the inactive meter. Once the step of reloading is completed, it is identified as a completed reload at 76.

Returning to decision diamond 62, it is determined whether the inactive meter has been reloaded. If not, a routine 78 for monitoring the integral pneumatic dispenser operations receives data that the inactive meter has not been reloaded. The routine 78 requests to reload at 66. The reload request is directed toward the system programming logic controller 74. The system programming logic controller 74 regulates all of the meters 28–38. Therefore, the system programming logic controller 74 determines when an inactive meter may be reloaded. The digital signal to reload is transmitted to decision diamond 68 via line 80. If the data signal implies that the inactive meter maybe reloaded, the signal is generated at block 72. If approval for reload has not been given, the method waits at 82 for 250 milliseconds and then determines whether the reload request time has expired at 84. If the reload request time has expired, a fault is generated at 86. If not, the system programming logic controller 74 determines whether a reload of the inactive meter is appropriate at 68.

If it was determined that a reload was appropriate, the reload operation would start at 70. A timer would be started at 88 and the method waits for approximately 250 milliseconds at 90. It is then determined whether the reload time has expired at 92. If so, a reload timeout fault is generated at 94. This ensures the robots 16–26 do not empty the two shotmeter cylinders (not shown) before one of them is reloaded. If the reload time has not expired, however, it is then determined whether the reload is completed at 96. If the reload is not completed, the method returns to the step of waiting 250 milliseconds at 90 before it tests whether the reload time has expired at 92.

If it is determined that the reload has completed at 76, that information is transmitted to decision diamond 62, as is graphically represented by the phantom arrow 98. Because the inactive meter has been reloaded, its status is switched to an active meter at 64. This status information is transmitted to the integral pneumatic dispenser operations routine at 78. Further, the information regarding the completed reload is transmitted to the routine 100 controlling the integral pneumatic dispenser operations 100 with the instructions to turn off the reload request at 102 to maximize the resources of the systems programming logic controller 74.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

What is claimed is:

1. A method for reloading a plurality of shotmeters supplying fluid material to a plurality of robots from a bulk supply, the method comprising the steps of:

activating one of the shotmeters to define a primary shotmeter;

dispensing the material from the primary shotmeter;

determining when the primary shotmeter becomes empty;

activating the other of the shotmeters to continue dispensing the material;

forwarding a request to reload the primary shotmeter that has been emptied;

receiving approval to reload the primary shotmeter that has been emptied; and reloading the primary shotmeter that has been emptied only when the primary shotmeter is the only one of the plurality of shotmeters relying on the bulk supply at that time.

2. A method as set forth in claim 1 including the step of waiting until the other of the plurality of shotmeters have completed reload before the step of receiving approval to reload the primary shotmeter.

3. A method as set forth in claim 2 including the step of identifying when the step of reloading has been completed.

4. A method as set forth in claim 1 including the step of measuring the capacities of the shotmeters.

5. A method as set forth in claim 4 including the step of increasing the number of shotmeters capable of being reloaded depending on the determination made during the step of measuring the capacities of the shotmeters.

6. A method as set forth in claim 3 including the step of timing the reload request to determine whether the robot will dispense all of the material in the shotmeters associated with the robot.

7. A method as set forth in claim 6 including the step of generating a fault to prevent the robot from emptying the shotmeters associated with the robot before one of the shotmeters is reloaded.

8. A method for reloading a plurality of shotmeters supplying fluid material to a plurality of robots from a bulk supply, the method comprising the steps of:

activating one of the shotmeters to define a primary shotmeter;

dispensing the material from the primary shotmeter;

determining when the primary shotmeter becomes empty;

activating the other of the shotmeters to continue dispensing the material;

forwarding a request to reload the primary shotmeter that has been emptied;

receiving approval to reload the primary shotmeter that has been emptied;

reloading the primary shotmeter that has been emptied only when the primary shotmeter is the only one of the plurality of shotmeters relying on the bulk supply at that time;

determining whether a reload time has expired; and generating a fault before the robot empties the plurality of shotmeters.

* * * * *